US007100316B2

(12) United States Patent
Obileye

(10) Patent No.: US 7,100,316 B2
(45) Date of Patent: Sep. 5, 2006

(54) COLLAPSIBLE IRONING BOARD

(76) Inventor: Olufemi Obileye, 4 Cavendish Gardens, Winnersh, Berkshire (GB) RG41 5TG ( * ) Notice: Subject to any disclaimer, the term of this patent is extended or adjusted under 35 U.S.C. 154(b) by 0 days.

(21) Appl. No.: 10/515,903

(22) PCT Filed: May 30, 2003

(86) PCT No.: PCT/GB03/02355

§ 371 (c)(1),
(2), (4) Date: Nov. 24, 2004

(87) PCT Pub. No.: WO03/101252

PCT Pub. Date: Dec. 11, 2003

(65) Prior Publication Data

US 2005/0204592 A1 Sep. 22, 2005

(30) Foreign Application Priority Data

May 30, 2002 (GB) ..... 0212428.7

(51) Int. Cl.
*D06F 81/00* (2006.01)
*A47B 5/04* (2006.01)
*D06F 81/06* (2006.01)

(52) U.S. Cl. ..... 38/139; 108/48

(58) Field of Classification Search ..... 38/135–139, 38/DIG. 1, DIG. 2, DIG. 3; 108/33, 48, 108/42, 63, 17, 20, 35, 40, 93
See application file for complete search history.

(56) References Cited

U.S. PATENT DOCUMENTS 2,199,981 A 5/1940 Bell
2,536,366 A * 1/1951 Harris et al. ..... 108/37
2,639,523 A * 5/1953 Beiger ..... 38/139
3,080,832 A 3/1963 Schroemges
3,609,892 A * 10/1971 Caire ..... 38/18
4,536,978 A * 8/1985 Cerutti ..... 38/103
4,789,123 A 12/1988 Mattsson
4,991,325 A * 2/1991 Teduschi ..... 38/138
5,669,314 A * 9/1997 Grant ..... 108/48
5,946,833 A 9/1999 Bottcher et al.
6,112,440 A 9/2000 Bottcher et al.
6,161,486 A * 12/2000 Boots ..... 108/48
6,253,472 B1 7/2001 Gast
2001/0052309 A1 12/2001 Allen

FOREIGN PATENT DOCUMENTS

WO WO 91/11130 A1 8/1991

* cited by examiner

*Primary Examiner*—Ismael Izaguirre
(74) *Attorney, Agent, or Firm*—Mitchell Silberberg & Knupp LLP

(57) ABSTRACT

Provided is a collapsible ironing board that includes a frame, a primary board and a secondary board. The primary board is pivotally attached to the frame at the rear edge of the primary board. The secondary board is slidably attached to the primary board such that the secondary board can be slid from a stored position in which the top surface of the secondary board is beneath the bottom surface of the primary board to an extended position in which the rear edge of the secondary board is in front of the front edge of the primary board and the top surface of the secondary board is at least approximately coplanar with the top surface of the primary board. An extendable/retractable shaft also is provided and has a proximal end that is pivotally attached to the frame and a distal end that is pivotally attached to the secondary board.

26 Claims, 12 Drawing Sheets

COLLAPSIBLE IRONING BOARD

BACKGROUND OF THE INVENTION

1. Field of the Invention

The present invention is directed to an ironing board and, more particularly, an ironing board that may be collapsed for efficient storage.

2. Description of the Related Art

Most conventional ironing boards may be folded so as to reduce the amount of space occupied by the ironing board when it is not in use. However, conventional ironing boards usually are difficult to manipulate, particularly for the elderly or the infirm. For example, probably the most common ironing board includes a board portion that provides the ironing surface and also includes a stand that supports the board portion. Folding such an ironing board requires the user to physically lift the entire assembly, stand it on its end or on its side, activate a lever that causes the stand to fold underneath the board portion, and then carry the entire assembly to its storage location. While this procedure is only an inconvenience for healthy individuals, it can be very difficult or even impossible for the elderly or the handicapped.

SUMMARY OF THE INVENTION

The present invention addresses this problem by providing a collapsible ironing board in which a secondary board can be slid from a stored position beneath a primary board to a deployed position where both the primary board and the secondary board form the ironing surface. Generally speaking, this is accomplished through the use of an expandable shaft that is pivotally connected at one end to a frame and at the other hand to the secondary board.

Thus, in one aspect the invention is directed to a collapsible ironing board that includes a frame, a primary board and a secondary board. The primary board is pivotally attached to the frame at the rear edge of the primary board. The secondary board is slidably attached to the primary board such that the secondary board can be slid from a stored position in which the top surface of the secondary board is beneath the bottom surface of the primary board to an extended position in which the rear edge of the secondary board is in front of the front edge of the primary board and the top surface of the secondary board is at least approximately coplanar with the top surface of the primary board. An extendable/retractable shaft (such as a pneumatic, hydraulic or other pressurized piston/cylinder mechanism) also is provided and has a proximal end that is pivotally attached to the frame and a distal end that is pivotally attached to the secondary board.

With the foregoing configuration, the extendable/retractable shaft can be used to deploy and to collapse the ironing board, thereby typically reducing the amount of work required by the end user. In the preferred embodiments of the invention, the primary and secondary boards are stored in a vertical orientation, with the secondary board underneath (or, more accurately, behind) the primary board. Also in the preferred embodiments, the extendable/retractable shaft is a pneumatic piston/cylinder mechanism, similar to a shock absorber; therefore, after an initial pull (which may also be achieved with the aid of a lever or otherwise, e.g., a locking type mechanism) to start the deployment (e.g., to rotate the board assembly past the equilibrium point), the shaft takes over and raises and extends the board into the fully operational position.

A provided locking mechanism then secures the board into the operational position. By releasing this mechanism and simultaneously pressing downwardly and rearwardly the ironing board can be returned to the storage position.

The carriage mechanism for permitting the secondary board to extend from and slide out from underneath the primary board can be configured in a variety of ways. In one embodiment described below, it is implemented as a J-shaped groove in a bracket attached to each of the right side and the left side of the primary board, with a pin in each side of the secondary board, together guiding the movement of the secondary board in the appropriate manner. In another embodiment described below, it is implemented as a telescoping track attached to each of the right side and the left side of the primary board and the secondary board (similar to many conventional drawer glides), together with multiple pivot arms to accommodate the vertical movement of the secondary board.

Additional features of the invention are contemplated and are described in more detail below. For example, the entire frame supporting the ironing board assembly may be pivotally mounted to a housing in which the frame and assembly are housed, so that the ironing board may be rotated into a desired position. Also, the housing (or the frame, particularly in cases where no separate housing is utilized) may be provided with a lifting mechanism for adjusting the height of the ironing board.

The foregoing summary is intended merely to provide a brief description of the general nature of the invention. A more complete understanding of the invention can be obtained by referring to the claims in view of the following detailed description of the preferred embodiments and the accompanying figures.

DESCRIPTION OF THE PREFERRED EMBODIMENT(S)

Figure 1:
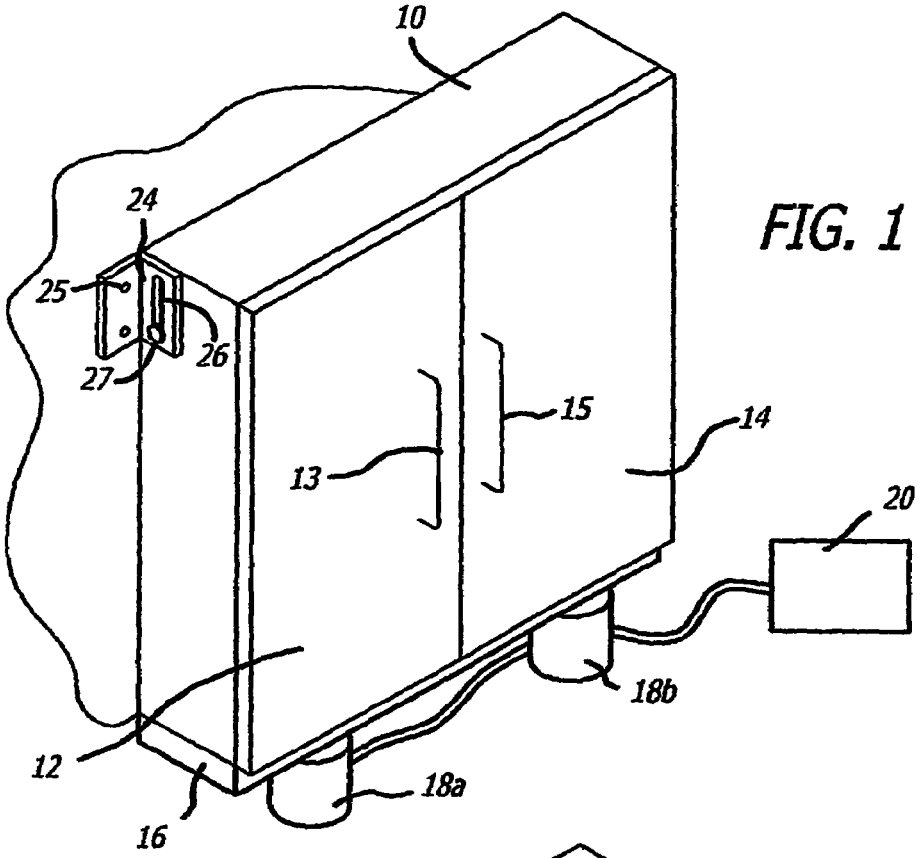
FIG. 1 is a perspective view of an ironing board housing according to a representative embodiment of the present invention.

FIG. 1 is a perspective view of an ironing board housing 10 according to a representative embodiment of the present invention. As shown in FIG. 1, from the outside housing 10 appears similar to many conventional cabinets, having two doors 12 and 14 with corresponding handles 13 and 15 for opening the doors. Unlike most other conventional cabinets, however, housing 10 includes a bottom platform 16 which, in turn, includes a lifting mechanism 18 for adjusting the height of the entire housing 10.

In the preferred embodiments of the invention, lifting mechanism 18 includes two hydraulic lifts, 18*a* and 18*b* which are operated by a pump 20 to lift the entire housing 10 to a desired height Preferably, pump 20 is either a foot-operated pump or an electric pump. In either case, a spring-biased release valve between the two hydraulic chambers preferably is provided for controlling the lowering of housing 10 (e.g., pressing the valve opens it, thereby causing housing 10 to lower and then when pressure is removed the spring returns the valve to the dosed position). Also, any other type of lifting mechanism may instead be used, such as a purely mechanical lifting mechanism (e.g., in the nature of a mechanical car jack).

Located on the side of housing 10 is a bracket 24 for guiding the upward and downward movement of housing 10 caused by lifting mechanism 18. As shown, bracket 24 is configured as an L-shaped bracket with two screw holes 25 on one plane of the "L" for mounting bracket 24 to a wall. On the other plane is a vertically oriented slot 26. A pin 27 is fixedly attached to housing 10 and disposed within slot 26 so that housing 10, when raised and/or lowered, travels within the line defined by slot 26. A similar bracket and pin preferably are provided on the other side of housing 10 as well. While the foregoing guide mechanism is preferred, any other lifting guide mechanism may instead be used, such as a peg-and-groove arrangement on the back of housing 10, e.g., running the entire height of housing 10.

Figure 2:
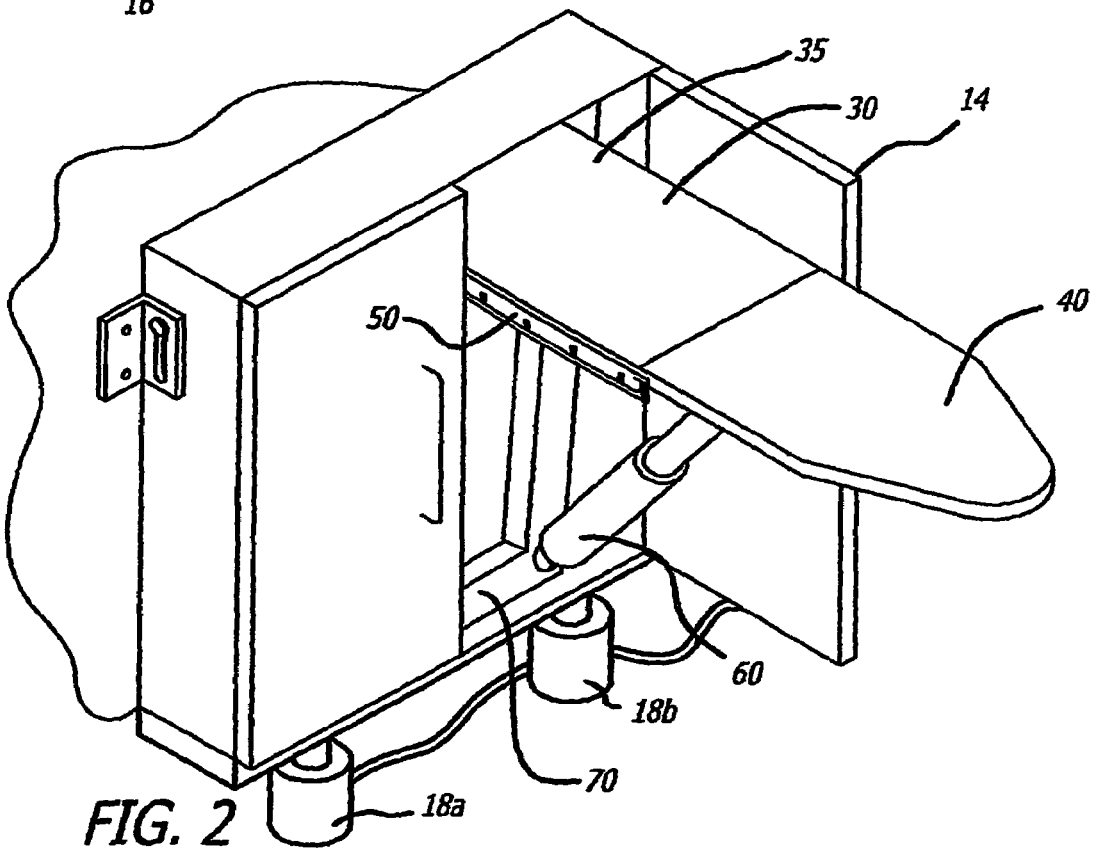
FIG. 2 is a perspective view of the housing shown in FIG. 1 with the left-side door open and the ironing board in the operational position.

FIG. 2 is a perspective view of an ironing board assembly in operational use according to the present invention. As shown in FIG. 2, the ironing board 30 is stored in one side only (the left side in FIG. 2) of housing 10. The other side of housing 10 preferably is available as storage space. Generally speaking, ironing board 30 will be significantly longer than the height or the width of housing 10. Nevertheless, this arrangement is accommodated by the unique mechanisms and techniques for collapsing and extending ironing board 30 according to the present invention, as described below.

Ironing board 30 includes two parts: an inner or primary board 35 and an outer or secondary board 40. Both of the primary board 35 and the secondary board 40 preferably are made of metal and capable of supporting at least 10 kilograms of weight A carriage system 50 allows secondary board 40 to slide underneath primary board 35 for storage and then to slide into the position shown in FIG. 2 in which secondary board 40 is arranged end-to-end with primary board 35 for operational use. The preferred mechanism for collapsing and extending ironing board 30 between the stored and operational positions utilizes an extendable/retractable shaft 60. Shaft 60 pivotally attaches to a frame 70 within housing 10 and also pivotally attaches to the secondary board 40.

In the preferred embodiments of the invention, shaft 60 is a pressurized pneumatic piston/cylinder mechanism, similar in nature to an automobile shock absorber. In any event, shaft 60 preferably is configured so as to tend toward expansion in length. Thus, for example, rather than using a pneumatic piston/cylinder mechanism, shaft 60 instead may be configured as a spring-loaded mechanism.

First Embodiment

Figure 3A:
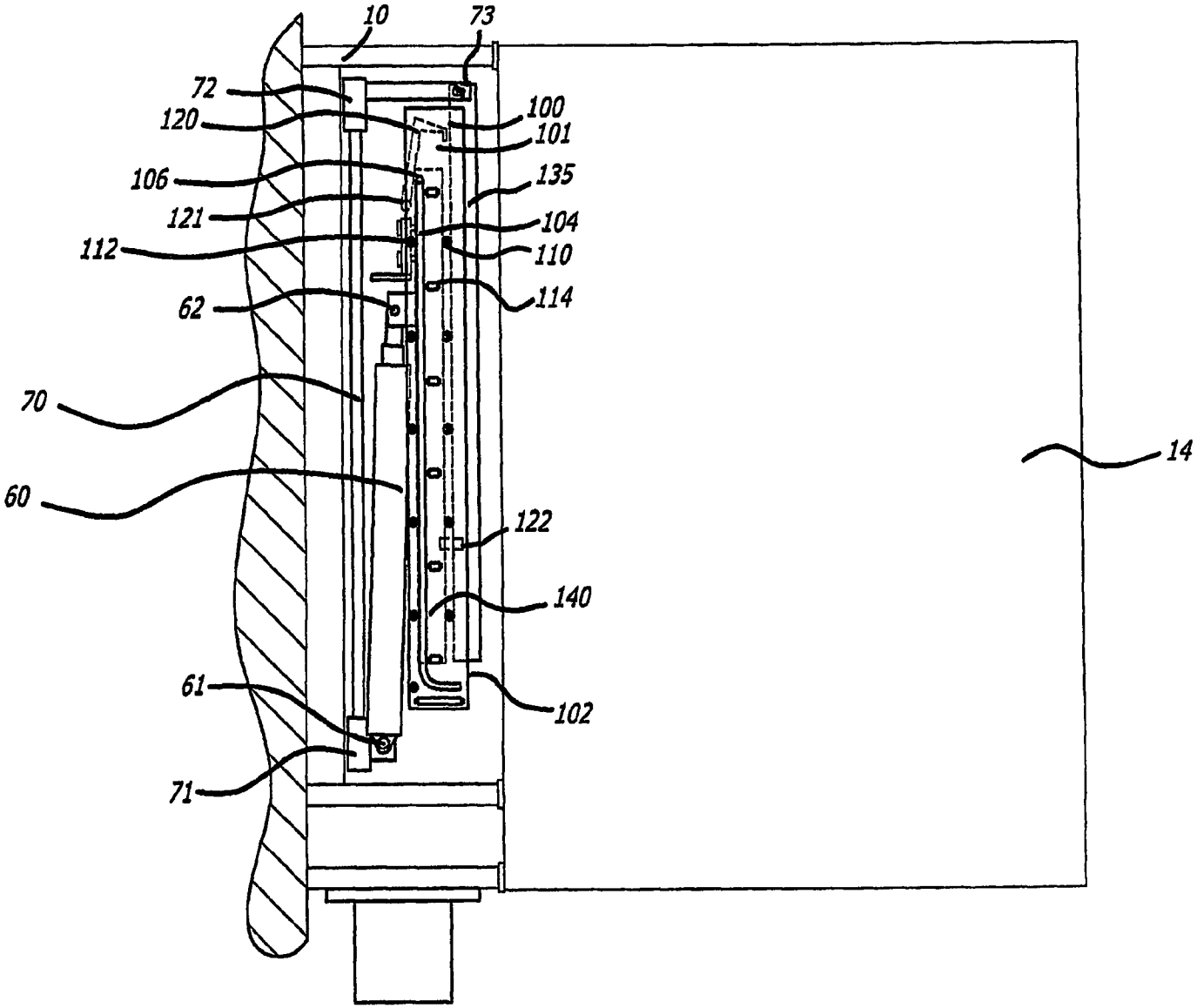
FIG. 3A is a right side cross-sectional view showing an ironing board assembly according to a first embodiment of the present invention, with the ironing board in the stored position.

FIG. 3A is a right side cross-sectional view showing an ironing board assembly 100 according to a first embodiment of the present invention, with the left side door 14 opened. As shown in FIG. 3A, the ironing board assembly 100 is in the stored position in housing 10. In this position, the primary board 135 and the secondary board 140 are oriented vertically, with the secondary board 140 immediately behind (or underneath) the primary board 135. As can be seen in FIG. 3A, in the stored position the primary board 135 overlaps the secondary board 140 along substantially the entire surface area of secondary board 140.

The carriage system 50 in this embodiment of the invention is configured as a guide assembly 101 mounted along each of the left and right sides of primary board 135. Guide assembly 101 includes a bracket or plate 102 that has formed within it a J-shaped groove 104 that preferably extends through the entire thickness of plate 102. Fixedly mounted to the rear end of the secondary board 140 is a pin 106 that fits within the groove 104. As seen in FIG. 3A, in the stored position pin 106 is at or near the rear end of groove 104. Each guide assembly 101 further includes multiple rollers, such as multiple top rollers 110, multiple bottom rollers 112 and multiple side rollers 114. Top rollers 110 abut the top surface of secondary board 140, and bottom rollers 112 abut its bottom surface, together reducing friction as secondary board 140 slides from the stored position to the operational position. Side rollers 114 abut the side of secondary board 140 and take up the tolerance between guide assembly 101 and secondary board 140.

A frame 70 supports the ironing board 30 and is mounted to the housing 10 using pivot joints 71 and 72. Another pivot joint 73 secures the rear end of primary board 135 to frame 70. Each of pivot joints 71–73 preferably is configured as a ball bearing mechanism of the type commonly found in vehicle wheels and preferably permits 360° rotational movement within a single plane. Pivot joints 71–73 preferably are robust enough to accommodate 20 kilograms of weight.

Shaft 60 is attached to a pivot joint 61 mounted on the bottom of frame 70 and to another pivot joint 62 mounted on the bottom surface of secondary board 140. In the preferred stored position, the distance between secondary board 140 and frame 70 is just large enough to accommodate the width of shaft 60, so that shaft 60 is nearly vertical.

As noted above, shaft 60 preferably is pressurized or otherwise configured in a manner that it is biased toward expansion in length. As further noted, the pivot point for primary board 135 is pivot joint 73. Accordingly, in the preferred stored position, the expansion force exerted by shaft 60 is behind the pivot point 73, tending to cause secondary board 140 (and primary board 135 to which it is attached) to rotate in the clockwise direction as viewed in FIG. 3A. This is a stable situation, causing the ironing board assembly 100 to remain in the stored position. As a result although a locking pin or similar device may be utilized to keep ironing board assembly 30 in the stored position (as discussed in more detail below), such a device generally will not be necessary. A locking mechanism 80 is provided, but as discussed in more detail below, locking mechanism 80 is primarily for securing ironing board assembly 100 in the operational position.

From the stored position, the ironing board assembly 100 may be manually rotated in the counter-clockwise direction (based on the orientation shown in FIG. 3A). Doing so also will cause shaft 60 to rotate about pivot point 61 and initially will cause a slight compression of shaft 60. Continuing such rotation eventually will result in a situation in which the line of force provided by shaft 60 intersects (i.e., in the side elevational view) the pivot point 73. This is the equilibrium point at which shaft 60 has no effect However, the weight of board assembly 100 will tend to continue to cause rotation in the clockwise direction. By continuing to manually rotate board assembly 100 a little further in the counter-clockwise direction a point will be reached at with the force exerted by shaft 60 exactly equals the weight of board assembly 100. This is the true equilibrium point, and beyond it shaft 60 will urge board assembly 100 in the counter-clockwise direction. In other words, letting go of ironing board assembly 100 at this point will allow shaft 60 to complete the extension of the ironing board without further manual assistance.

Due to the existence of guide assemblies 101, secondary board 140 is free to slide relative to primary board 135. Therefore, as shaft 60 rotates the entire board assembly 101 in the counter-clockwise direction, the expanding length of shaft 60 also causes secondary board 140 to slide out from underneath primary board 135, thereby extending the entire length of board 30.

Figure 3B:
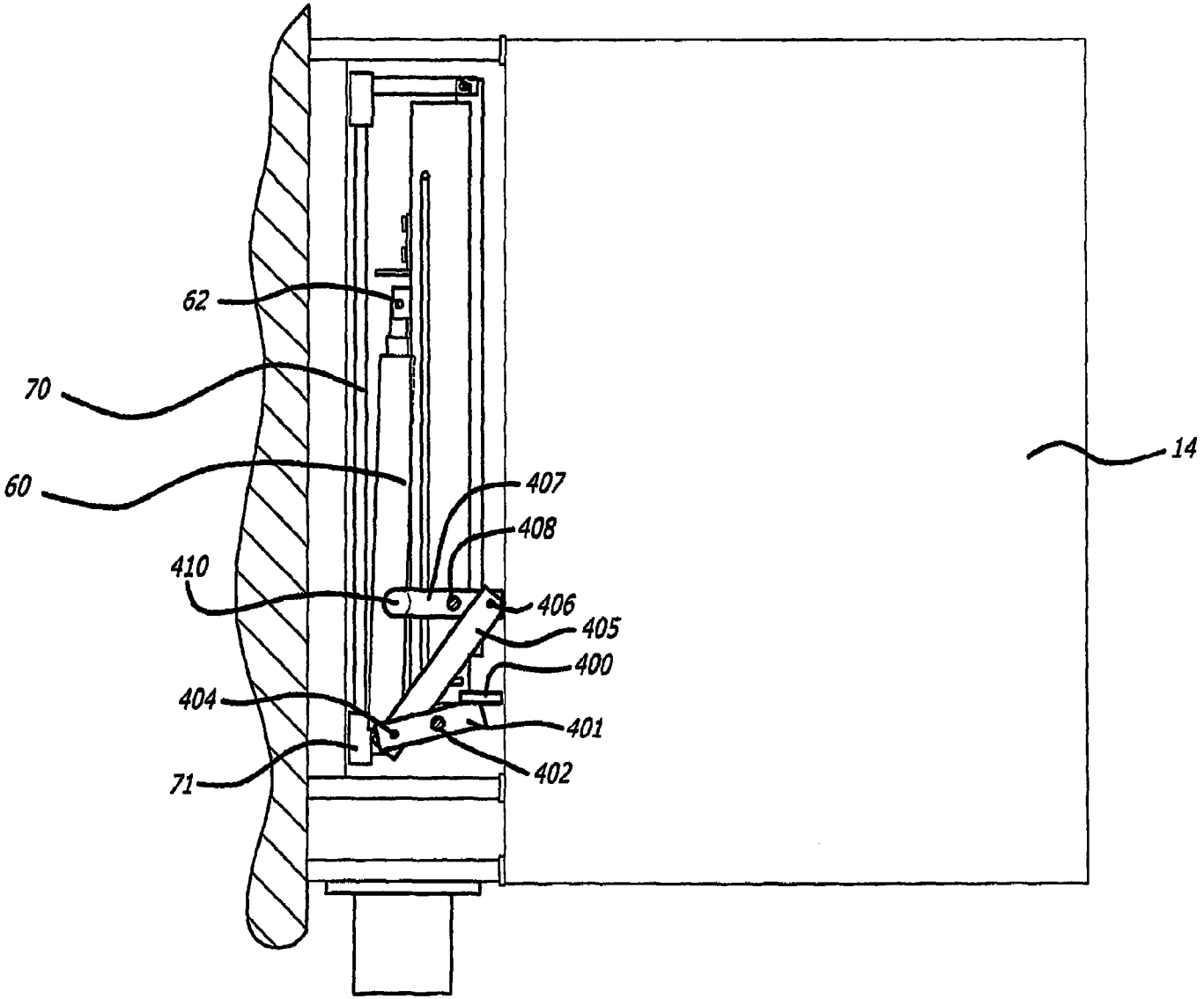
FIG. 3B is a right side cross-sectional view showing an ironing board assembly according to a first embodiment of the present invention, with the ironing board in the stored position and with an optional foot pedal for deploying the ironing board.

FIG. 3B illustrates the ironing board assembly 101 in the same configuration shown in FIG. 3A, but with the addition of an optional foot pedal mechanism for assisting in the deployment of assembly 101. This mechanism includes a foot pedal 400, mounted to a member 401. Member 401, in turn, is pivotally mounted to one of the side walls of the housing 10 at a point 402 and is pivotally mounted to a member 405 at a point 404. Member 405 is pivotally mounted to a member 407 at a point 406 and is pivotally mounted to the same side wall of housing 10 at a point 408. Extending from the end of member 407 is a bar 410 which extends inwardly (i.e., toward the center of housing 10, preferably perpendicular to member 407), but not sufficiently inwardly so as to interfere with shaft 60. Each of members 401, 405 and 407 preferably is a flat plate and preferably is formed of metal.

Depressing pedal 400 causes member 401 to rotate clockwise, raising member 405 and causing member 407 to rotate counter-clockwise. As a result, bar 410 presses against the underside of secondary board 140, thereby effecting the initial rotation of ironing board assembly 101 required to move past the true equilibrium point. Therefore no manual lifting is required. When ironing board assembly 101 is later returned to the stored position, the collapsing movement resets the foot pedal mechanism. Any other foot pedal mechanism may be used instead. Alternatively, a simple lever may be used, e.g., member 407 alone, mounted at point 408 and with bar 410.

Mounted to the bottom surface of secondary board 140 is a hook 120. In this embodiment, hook 120 is pivotally mounted to a sliding plate on the bottom surface of secondary board 140. Hook 120 is pivoted at point 121 and is biased upwardly (i.e., toward primary board 135) with the use of a coil spring at pivot point 121. More detail regarding this mounting technique and its benefits is described below. A matching anchor 122 is provided on primary board 135.

Figures 4A, 4B:
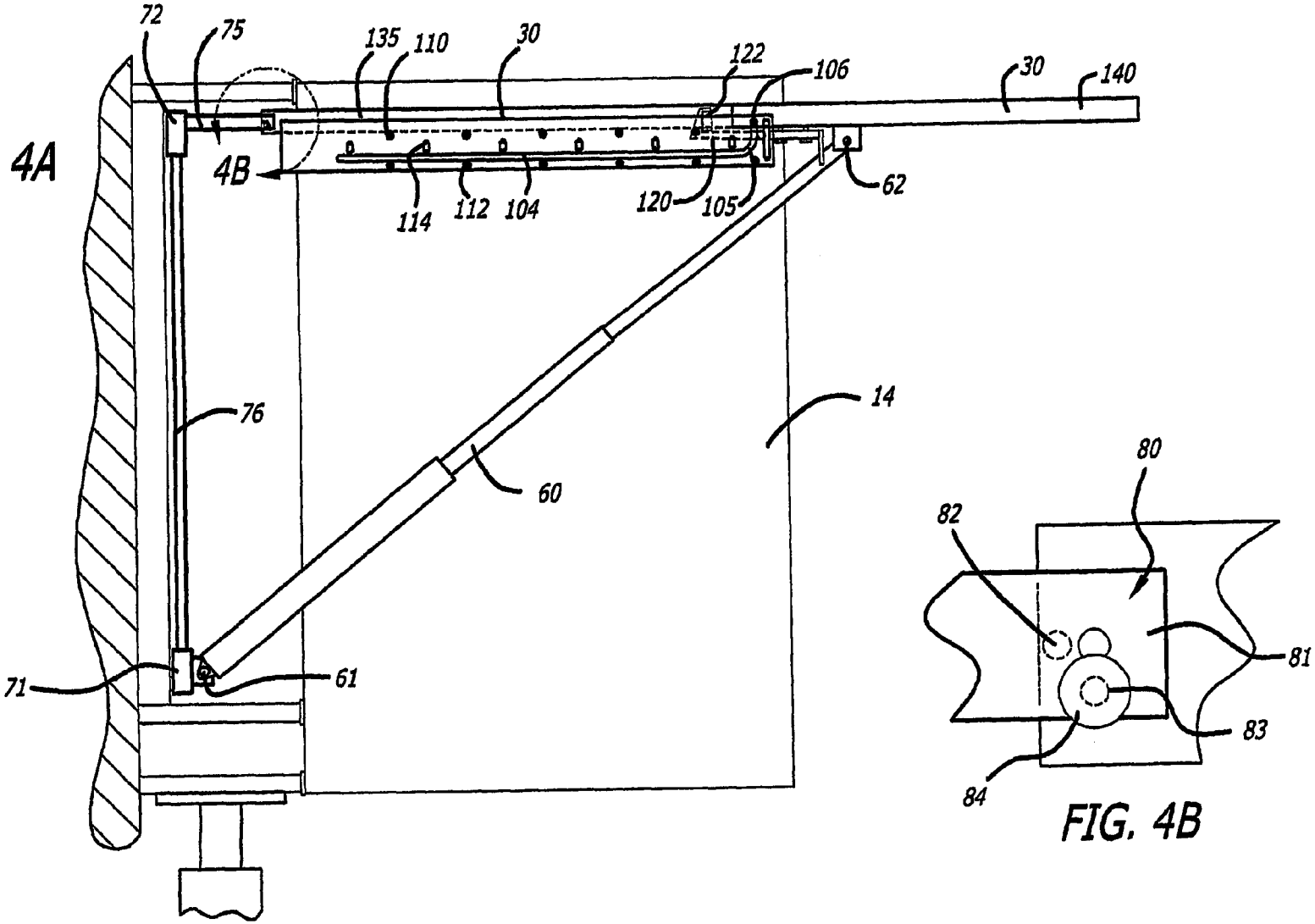
FIG. 4A is a right side cross-sectional view of an ironing board assembly according to the first embodiment of the present invention, with the ironing board in the operational position.
FIG. 4B is a more detailed right side elevational view of a locking pin assembly for preventing rotational movement of the primary board relative to the frame.

The general purpose of hook 120 and anchor 122 is as follows. Referring to FIG. 4A, at some point as the board assembly 100 is being rotated upwardly and concurrently extended in length, hook 120 catches onto anchor 122, thereby securing secondary board 140 to primary board 135.

Continued extension of shaft 60 causes secondary board 140 to extend outwardly and causes the entire ironing board assembly 100 to rotate upwardly, as guided by the movement of pin 106 through J-shaped groove 104. When pin 106 reaches the uppermost point in the J-curve 105 of groove 104 (as shown in FIG. 4A) the force provided by shaft 60 is unable to further move secondary board 140 with respect to primary board 135. At this point, ironing board assembly 100 has the appearance shown in FIG. 4A, with the secondary board 140 being end-to-end with the primary board 135 and with their top surfaces being at least approximately coplanar so that primary board 135 and secondary board 140 together comprise a single ironing board surface. The engagement of hook 120 onto anchor 122 prevents any separation of secondary board 140 from primary board 135. In addition, the force exerted by shaft 60 resists any such separation.

At the same time, further rotational movement of board assembly 100 about pivot point 73 is prevented, e.g., in the following manner. FIG. 4B is a more detailed right side elevational view of locking pin assembly 80 for preventing rotational movement of the primary board relative to the frame. Preferably, assembly 80 is provided near the rear end of primary board 135. Assembly 80 essentially consists of a steel plate 81 having a storage position 82 and a deployed-position hole 83. Plate 81 is rigidly mounted to frame 70. Attached to the rear end of primary board 135 is a (preferably spring-loaded) locking pin 84. As indicated, in the stored position, locking pin 84 is located at position 82. Then, the counter-clockwise rotation of board assembly 100 causes the position of pin 84 to rotate in the same direction, toward hole 83. If pin 84 is spring-loaded, then it will automatically insert into hole 83 when it reaches that position. Otherwise, pin 84 may be manually inserted into hole 83. In either event, once inserted in this manner further rotation beyond the position shown in FIG. 4A in either direction) is inhibited.

It is possible to include a hole at storage position 82. In this event, ironing board assembly 100 may be locked into the stored position as well as the operational position. However, as noted above, this generally will not be necessary, as the preferred embodiments of the present invention inherently provide a stable storage position. Nevertheless, such a locking mechanism may be desirable when transporting the entire system to another location.

As noted above, frame 70 is pivotally attached to housing 10 using pivot joints 71 and 72. Accordingly, frame 70 (together with ironing board assembly 100) is capable of being rotated into any desired position from being perpendicular to housing 10 to being parallel to housing 10. FIG. 4A illustrates the appearance of ironing board 30 when initially deployed (i.e., extending perpendicularly out of housing 10). Thereafter, ironing board 30 may be rotated as desired.

Figure 5:
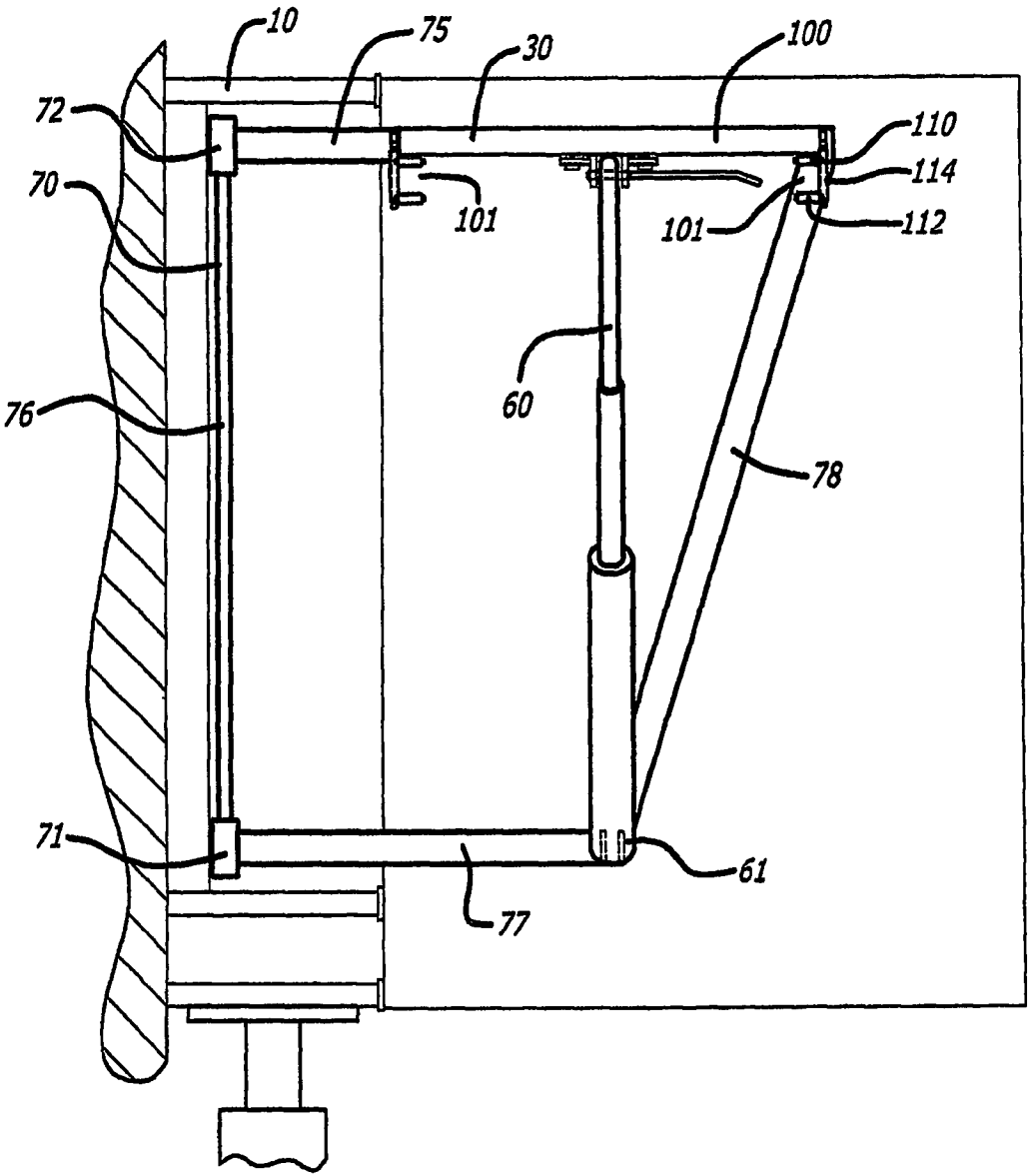
FIG. 5 is a right side cross-sectional view of an ironing board assembly according to the first embodiment of the present invention, with the ironing board in the operational position and the entire frame assembly rotated 90 degrees clockwise.

FIG. 5 is a right side cross-sectional view of ironing board assembly 100, as fully rotated after deployment, e.g., 90 degrees clockwise to a position in which ironing board 30 is parallel to housing 10. In this position, it is possible to more clearly see certain aspects of the configuration of frame 70 according to the preferred embodiments of the invention. As shown, frame 70 has a generally trapezoidal appearance, with a substantially horizontal upper member 75 to which the rear end of primary board 135 (not capable of being shown in this view) attaches, a substantially vertical inner member 76 which includes pivot joints 71 and 72, a substantially horizontal bottom member 77 and an angled outer member 78. The bottom pivot joint 61 for shaft 60 is disposed at the vertex of bottom member 77 and outer member 78. In this fully extended position, guide assemblies 101 remain mounted underneath primary board 135 and are more visible now that secondary board 140 has been raised to the same level as primary board 135. For example, it can be seen that side rollers 114 occupy the entire space between top rollers 110 and bottom rollers 112 in this embodiment of the invention.

Figure 6A:
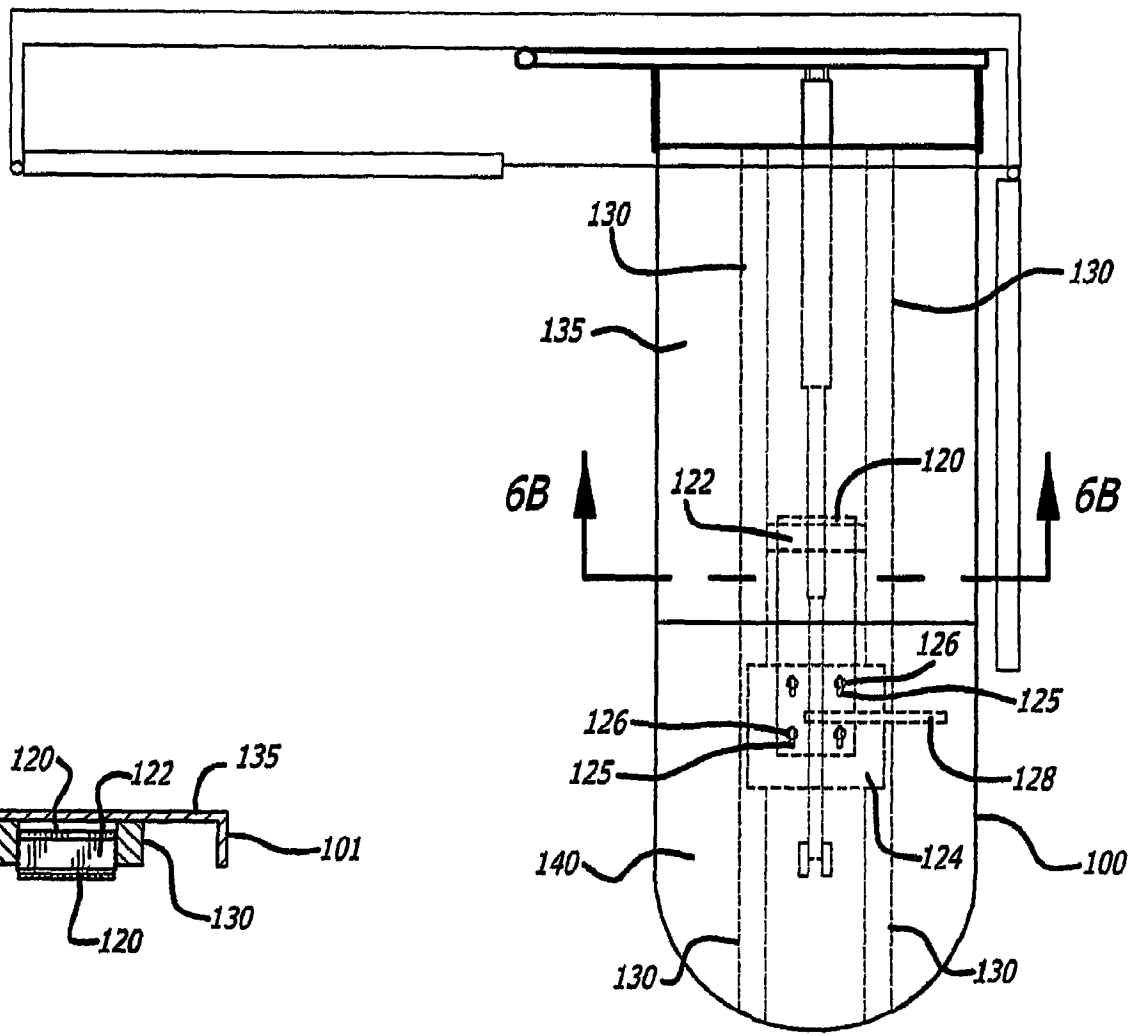
FIG. 6A is a top plan view of an ironing board assembly according to the first embodiment of the present invention, with the ironing board in the operational position.

FIG. 6A illustrates a top plan view of ironing board assembly 100 in the same position shown in FIG. 4A. As can be seen in FIG. 6A, in the preferred embodiments of the invention, each of primary board 135 and secondary board 140 has two parallel support rails 130. Mounted on the primary board 135 is anchor 122 between the support rails 130.

Latched onto anchor 122 is hook 120, which in turn is mounted on a slidable plate 124. In the present embodiment, plate 124 has four short grooves 125 within it. Mounted into secondary board 140 are four corresponding pins 126. As a result of this configuration, plate 124 is able to slide frontward and backward a total distance equal to the length of grooves 125 less the diameter of pins 126. Any other conventional sliding means may of course instead be used to achieve the same result. As shown in FIG. 6A, plate 124 is as far forward as it can travel. In the present embodiment, plate 124 is spring-biased into this position. However, a handle 128 is provided for manually sliding plate 124 backwards.

Figure 6B:
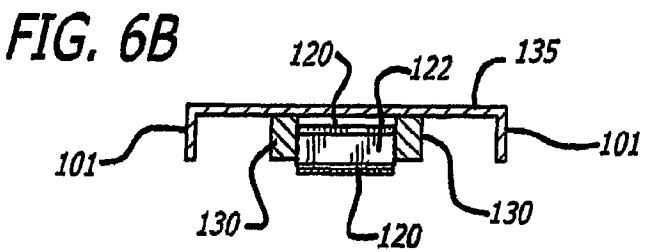
FIG. 6B illustrates a cross-sectional view of the hook/anchor attachment for securing the secondary board to the primary board according to a representative embodiment of the present invention.

FIG. 6B provides a cross-sectional view along the plane shown in FIG. 6A, thereby illustrating more clearly the foregoing hook/anchor attachment for securing the secondary board to the primary board. As illustrated in FIG. 6B, hook 120 extends under, around and then looks over anchor 122.

Figure 7:
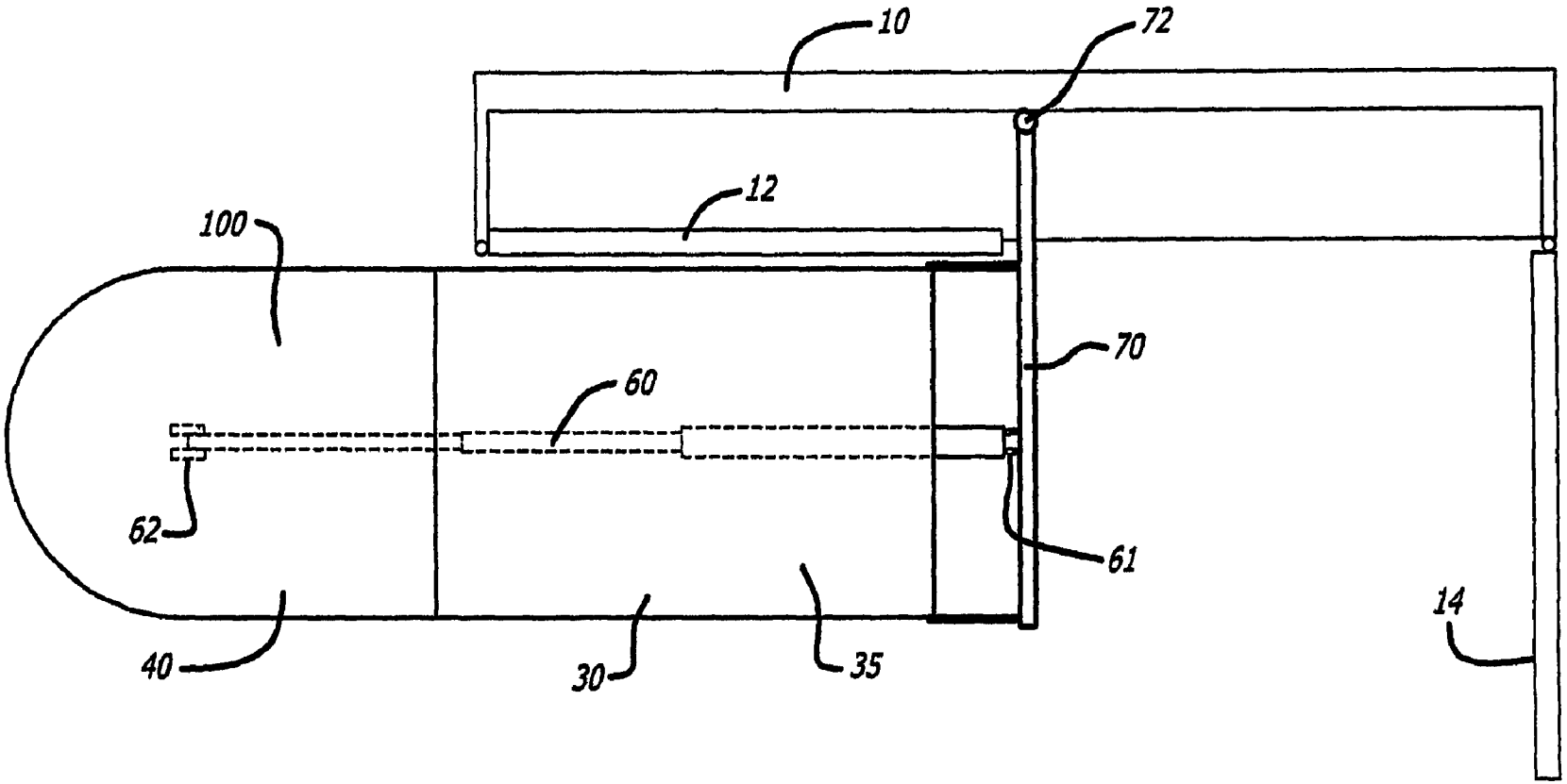
FIG. 7 is a top plan view of an ironing board assembly according to the first embodiment of the present invention, with the ironing board in the operational position and the entire frame assembly rotated 90 degrees clockwise.

FIG. 7 illustrates a top plan view of ironing board assembly 100 in the same position shown in FIG. 5. As shown, ironing board 30 is parallel to housing 10 in this orientation. It is noted that frame 70 may be rotated about pivot joints 71 (not capable of being shown in this figure) and 72 at any time prior to, during or after deployment of ironing board 30.

Referring back to FIG. 6A, in order to return ironing board assembly 100 to the stored position, handle 128 is pushed rearwardly, thereby moving plate 124 and hook 120 and causing hook 120 to separate from anchor 122. In addition, locking pin 84 is removed from hole 83 and the entire assembly 100 is pushed downward, causing secondary board 140 to return to its storage position underneath primary board 135 and, correspondingly, the entire assembly 100 to return to the stored position shown in FIG. 3A.

In the foregoing embodiment, plate 124 is capable of sliding forward and backward and preferably is spring-biased in the forward direction. In alternate embodiments, plate 124 may be freely slidable with handle 128 also rotating to activate an over-the-center latch to lock plate 124 into position. In this alternate embodiment, once shaft 60 extends secondary board 140, the user pulls handle 128 forward to tighten the attachment between primary board 135 and secondary board 140, and then rotates handle 128 upwardly to lock plate 124 into position. Then, in order to return ironing board assembly 100 to the stored position, handle 128 is first rotated downwardly and then pushed rearwardly to release hook 120.

Second Embodiment

Figure 8:
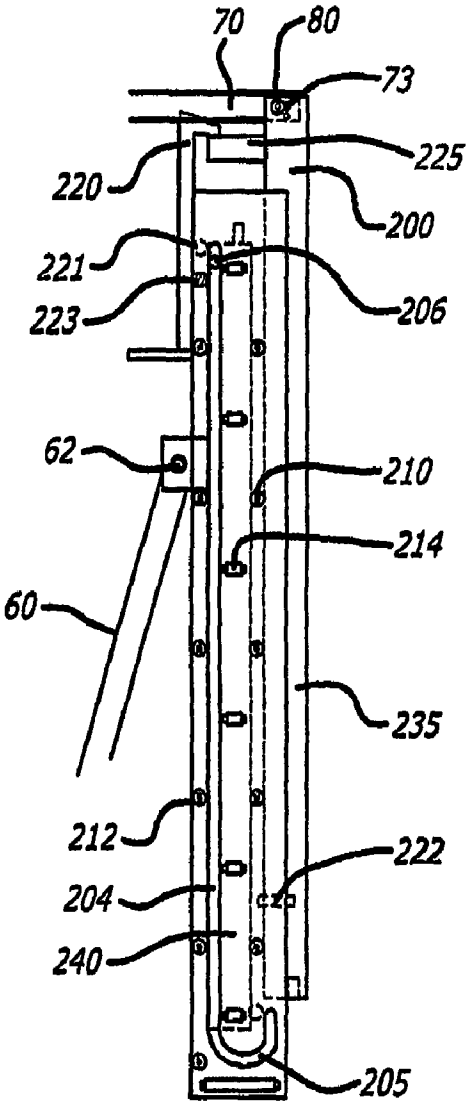
FIG. 8 is a right side cross-sectional view showing an ironing board assembly according to a second embodiment of the present invention, with the ironing board in the stored position.

FIG. 8 is a right side cross-sectional view showing an ironing board assembly 200 according to a second embodiment of the present invention, with the ironing board in the stored position. Many of the elements in this embodiment that are similar to those described in the first embodiment are not described in detail (or sometimes even shown) here. Thus, for example, this embodiment uses a similar housing 10, lifting mechanism 18, pump 20, shaft 60, frame 70, primary board pivot joint 73 and locking pin assembly 80, as well as similar joints 61, 62, 71 and 72. However, the carriage mechanism 50 in this embodiment is different, as are certain features related to how the primary board 235 and secondary board 240 fit together.

As shown in FIG. 8, in the stored position ironing board assembly 200 looks similar to assembly 100 in the first embodiment, in that the secondary board 240 is underneath primary board 235 and sits between two guide assemblies 201 that are mounted on the right and left sides of primary board 235. Each guide assembly 201, in turn, includes a J-shaped groove 204, top rollers 210, bottom rollers 212 and side rollers 214. A pin 206, mounted near the rear end of secondary board 240, is seated within J-shaped groove 204. However, as will become apparent below, J-shaped groove 204 is somewhat different than J-shaped groove 104.

Primary board 235 has an anchor 222 and secondary board 240 is provided with a hook 220. Hook 220, in turn, has a pivot point 221, but is biased upwardly in this embodiment of the invention by a separate compression spring 223 that is disposed behind pivot point 221. Also, in this embodiment a storage anchor 225 is provided for locking the ironing board assembly 200 into position while in the stored position. Pressing handle 228 to the right (as viewed in FIG. 8) will release hook 220 and allow the assembly to be rotated counter-clockwise, as in the previous embodiment (provided that locking pin 84 also must be released, if stored-position hole 82 has been included in plate 81 and pin 84 is inserted through it).

Other than this one difference in releasing board assembly 200 from the stored position, as compared to board assembly 100, the process and considerations for starting to deploy board assembly 200 into the operational position are the same. However, once board assembly 200 nears full extension and pin 206 approaches the end curve 205 of J-shaped groove 204, certain differences become apparent in comparison to the first embodiment.

Figure 9:
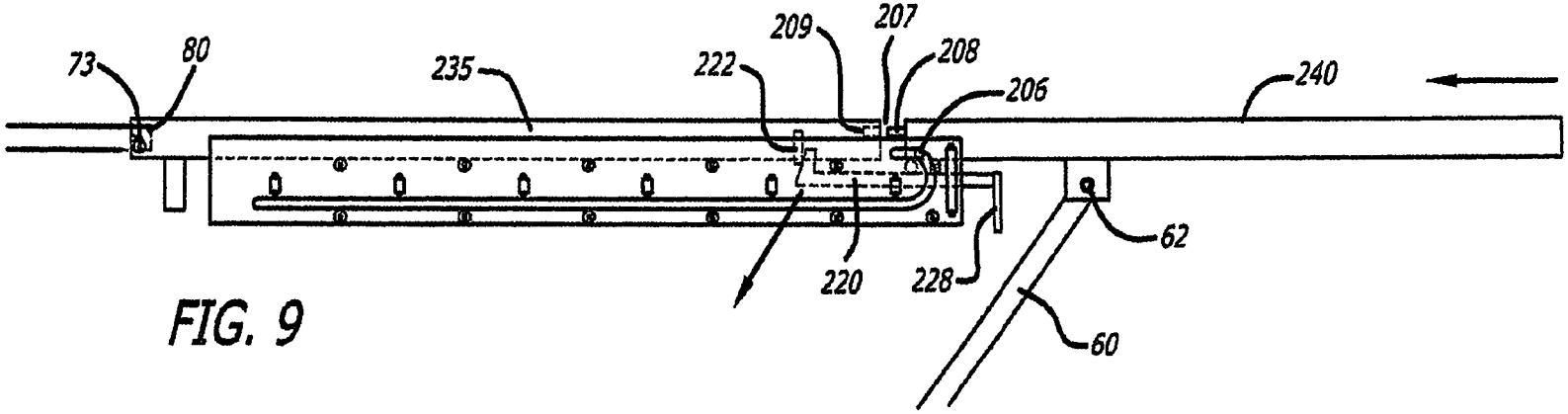
FIG. 9 is a right side cross-sectional view of an ironing board assembly according to the second embodiment of the present invention, with the ironing board fully extended.

This is illustrated in FIG. 9, which shows board assembly 200 fully extended (i.e., with shaft 60 allowed to extend as far as possible). As in the previous embodiment, locking pin assembly 80 locks primary board 235 into the horizontal orientation shown, preventing it from rotating any further. Due to the different shape of end curve 205, secondary board 240 swings out to a position approximately coplanar with, but just in front of primary board 235, leaving a gap 207 between them. Preferably, gap 207 is approximately 5 centimeters (cm) in length. Extending from secondary board 240 are one or more pegs 208 that are not quite as long as gap 207. One or more slots 209, matching pegs 208 in diameter and length, are provided in primary board 235. In addition, in the position shown in the FIG. 9, hook 220 is directly in front of anchor 222.

Figure 10:
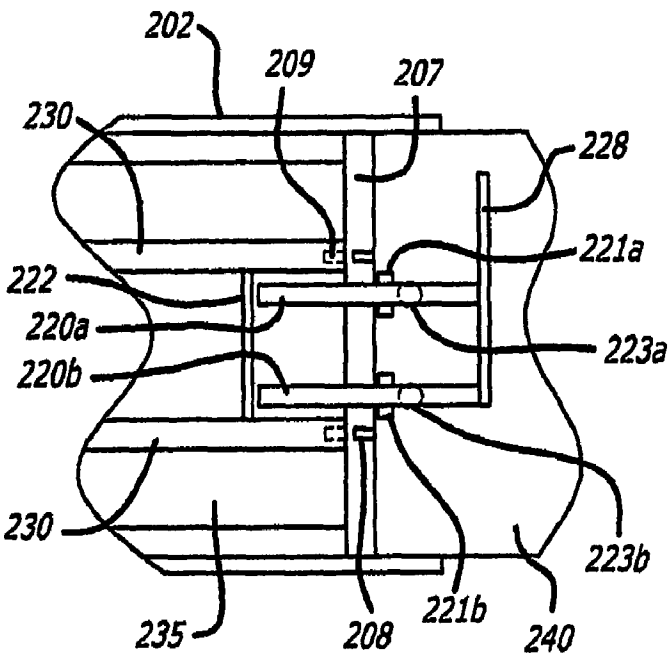
FIG. 10 is a bottom plan view of a portion of the ironing board according to the second embodiment of the invention, with the ironing board fully extended.

A bottom plan view of ironing board assembly 200 in the vicinity of gap 207, in the same configuration shown in FIG. 9, is shown in FIG. 10. In this embodiment, as shown in FIG. 10, hook 220 includes two separate arms 220*a* and 220*b*, with corresponding pivot points 221*a* and 221*b* and corresponding compression springs 223*a* and 223*b*. However, a single arm may instead be used. Anchor 222 is similar to anchor 122, described above, and is disposed between support rails 230 on primary board 235.

Referring to FIGS. 9 and 10, starting with the board assembly 201 in the configuration shown in those figures and manually sliding secondary board 240 in a straight horizontal manner causes pegs 208 to insert into slots 209. Also, due to the angled rear edge of hook 220, this action causes hook 220 to rotate downwardly, slide underneath anchor 222 and then, upon clearing anchor 222, to snap back up, thereby engaging with anchor 222 at the point where primary and secondary boards 235 and 240 abut each other.

Figure 11:
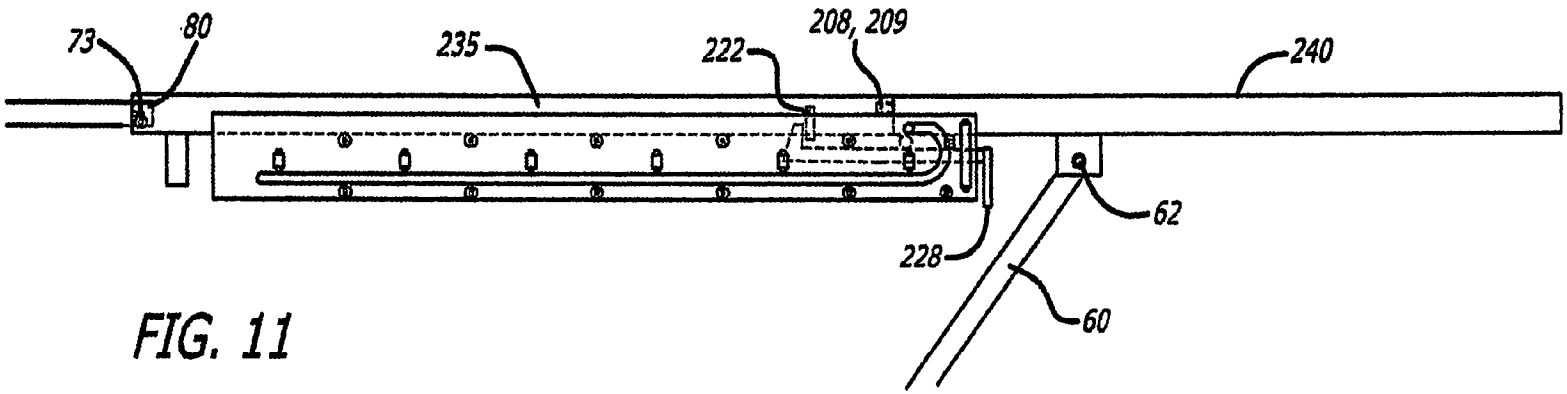
FIG. 11 is a right side cross-sectional view of an ironing board assembly according to the second embodiment of the present invention, with the ironing board in the operational position.

The end result is illustrated in FIG. 11. In this configuration, hook 220 and anchor 222 together prevent secondary board 240 from extending out further, the contact between primary and secondary boards 235 and 240 prevents secondary board 240 from moving inwardly, and locking pin assembly 80 prevents the entire assembly 200 from rotating about pivot point 73.

In order to return ironing board assembly 200 to the stored position, handle 228 is pushed upwardly, thereby releasing hook 220 from anchor 222. In addition, locking pin 84 is removed from hole 83 and the entire assembly 200 is pushed downwardly, causing secondary board 240 to return to its storage position underneath primary board 235 and, correspondingly, the entire assembly 200 to return to the stored position shown in FIG. 8. This motion also causes hook 220 to reengage with storage anchor 225 in the same manner described above in which hook 220 attaches to anchor 222 when the board assembly 200 is being deployed.

Third Embodiment

Figure 12:
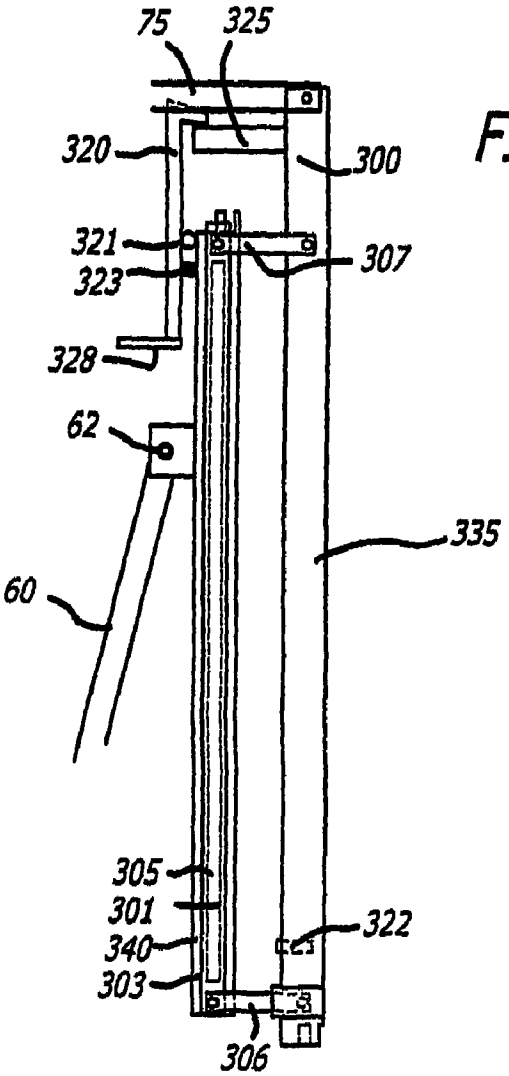
FIG. 12 is a right side cross-sectional view of an ironing board assembly according to a third embodiment of the present invention, with the ironing board in the stored position.

FIG. 12 illustrates an ironing board assembly 300 according to a third embodiment of the invention. Once again, many of the components of ironing board assembly 300 are similar to those shown in the first two embodiments, discussed above, and therefore not discussed in detail here. Thus, for example, this embodiment also uses a similar housing 10, lifting mechanism 18, pump 20, shaft 60, frame 70, primary board pivot joint 73 and locking pin assembly 80, as well as similar joints 61, 62, 71 and 72, as are used in the first and second embodiments. In fact, for clarity of illustration many of those elements are not even shown in FIG. 12 or the other figures pertaining to the following description of this third embodiment. However, once again the carriage mechanism 50 in this embodiment is different from the carriage mechanism 50 employed in either of the previous embodiments, as are certain features related to how the primary board 335 and secondary board 340 fit together.

As shown in FIG. 12, in the stored position the secondary board 340 is underneath primary board 335 and sits between two guide assemblies 301 that are mounted on the right and left sides of primary board 335. Each guide assembly 301, in turn, includes an outer track 303 and an inner track 305 that telescopes into outer track 303, allowing the inner track 305 to slide in and out of outer track 303. In order to facilitate this sliding motion, various devices may be employed to reduce friction between the outer track 303 and the inner track 305, such as rollers or ball bearings. Essentially, the sliding mechanism of this embodiment preferably is configured in a manner similar to the mechanism used for many conventional drawer glides, and any or all of the options in designing such a conventional drawer glide generally will be applicable to the present sliding mechanism as well.

In the present embodiment of the invention, outer track 303 is pivotally connected to a front pivot arm 306 and a rear pivot arm 307 which, in turn, are each pivotally connected to primary board 335. Also in the present embodiment, the inner track 305 is mounted along the side edge of secondary board 340. A similar pair of pivot arms 306 and 307, a similar outer track 303 and a similar inner track 305 are provided on the left side of the board assembly 301 (not shown in FIG. 12). Preferably, each of pivot arms 306 and 307 is configured as a flat rectangular metal plate with a hole at each end for insertion of a pin, thereby allowing each said pivot arm to rotate about such pin.

Primary board 335 has an anchor 322 and secondary board 340 is provided with a hook 320. Hook 320, in turn, has a pivot point 321, but is biased upwardly in this embodiment of the invention by a separate compression spring 323 that is disposed behind pivot point 321. Also, in this embodiment a storage anchor 325 is provided for locking the ironing board assembly 300 into position while in the stored position. Pressing handle 328 to the right (as viewed in FIG. 12) will release hook 320 and allow the board assembly 300 to be rotated counter-clockwise, as in the previous embodiments (provided that locking pin 84 also must be released, if stored-position hole 82 has been included in plate 81 and pin 84 has been inserted through it).

Thus, the process and considerations for starting to deploy board assembly 300 into the operational position are the same as those for board assembly 200, described above. However, the extension of secondary board 340 with respect to primary board 335 is significantly different than the corresponding extension in the second embodiment Rather than a pin traveling along a J-shaped groove in order to guide the extension, the extension in this embodiment of the invention is guided by the sliding action of inner track 305 relative to outer track 303.

Figure 13:
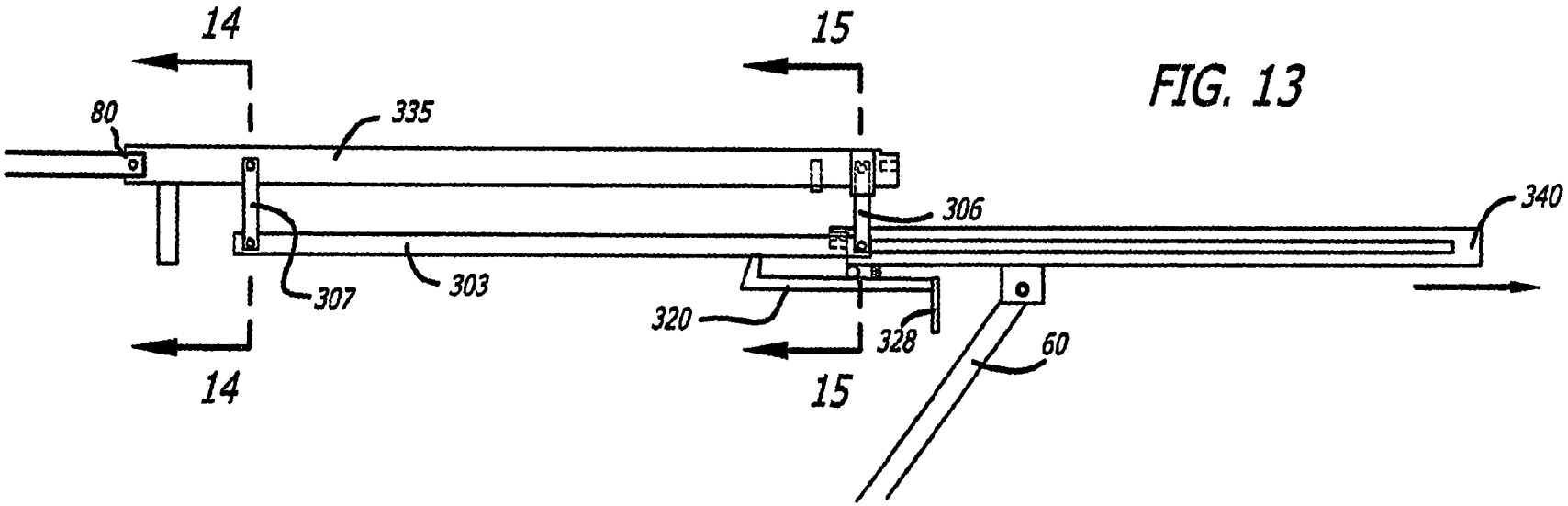
FIG. 13 is a right side elevational view of an ironing board assembly according to the third embodiment of the present invention, with the ironing board fully extended.

FIG. 13 shows board assembly 300 with secondary board 340 fully extended relative to primary board 335. As in the previous embodiments, locking pin assembly 80 locks primary board 335 into the horizontal orientation shown, preventing it from rotating any further. At this point, secondary board 340 still is lower than primary board 335 because the inner and outer tracks 305 and 303, respectively, preferably only permit linear movement. However, with secondary board 340 fully extended and locking pin assembly 80 preventing further rotation of primary board 335, the force exerted by shaft 60 can only be used to rotate secondary board 340 into a position approximately coplanar with primary board 335. This occurs through the action of pivot arms 306 and 307. It is noted that some pivoting of pivot arms 306 and 307 (and corresponding lifting of secondary board 340) may have occurred prior to this point. However, because the amount of effort required for such lifting generally will be significantly greater than the effort merely to slide secondary board 340 outwardly board to rotate the assembly 300 about pivot point 73, most of such lifting will occur at the position shown in FIG. 13.

Figure 14:
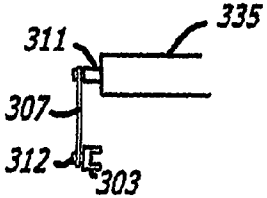
FIG. 14 is a partial cross-sectional view of the rear pivot arm assembly along the plane indicated in FIG. 13.

FIG. 14 is a cross-sectional view which shows more detail regarding the preferred implementation of pivot arm 307. As indicated, at its top end pivot arm 307 is pivotally connected to primary board 335 through the use of a pin 311 extending through a hole in the top end of pivot arm 307. At its bottom end, pivot arm 307 is pivotally connected to outer track 303 through the use of a pin 312 extending through a hole in the bottom end of pivot arm 307.

Figure 15:
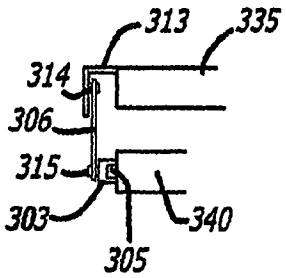
FIG. 15 is a partial cross-sectional view of the front pivot arm assembly along the plane indicated in FIG. 13.

Preferably, however, the implementation of pivot arm 306 is somewhat different, in order to avoid interference when secondary board 340 is rotated up into the same plane as primary board 335. This implementation is illustrated in FIG. 15. As shown, an L-shaped bracket 313 is used to space pivot arm 306 away from the edge of primary board 335. A pin 314 then extends from the outer surface of bracket 313 through a hole in the top end of pivot arm 306, thereby permitting pivot arm 306 to rotate relative to primary board 335. At its bottom end, pivot arm 306 is attached to outer track 303 in a similar manner as is pivot arm 307, i.e., in this case using a pin 315 that extends from outer track 303 through a hole in the bottom end of pivot arm 306. Here, however, with the board assembly 300 in the position illustrated in FIG. 13, the portion of outer track 303 which is attached to pivot arm 306 still encloses a portion of inner track 305 (unlike the portion of outer track 303 illustrated in FIG. 14). Nevertheless, with the gap provided by bracket 313, inner track 305 and secondary board 340 are accommodated as secondary board 340 is rotated up into the same plane as primary board 335.

Through the use of pivot arms 306 and 307, secondary board 340 swings out to a position (shown in FIG. 16) approximately coplanar with, but just in front of primary board 335, leaving a gap 310 between them. Preferably, gap 310 is approximately 5 cm in length. It is noted that the top surface of L-shaped bracket 313 prevents secondary board 340 from rotating significantly beyond this coplanar position. Extending from secondary board 340 are one or more pegs 308 that do not fully dose this gap 310. One or more matching slots 309 are provided in primary board 335. In this position hook 320 is directly in front of anchor 322. Also, as seen in FIG. 16, in this embodiment of the invention secondary board 340 includes an extension portion 317 and primary board 335 includes a matching recessed portion 318 which fit together so as to form a planar surface.

Figure 17:
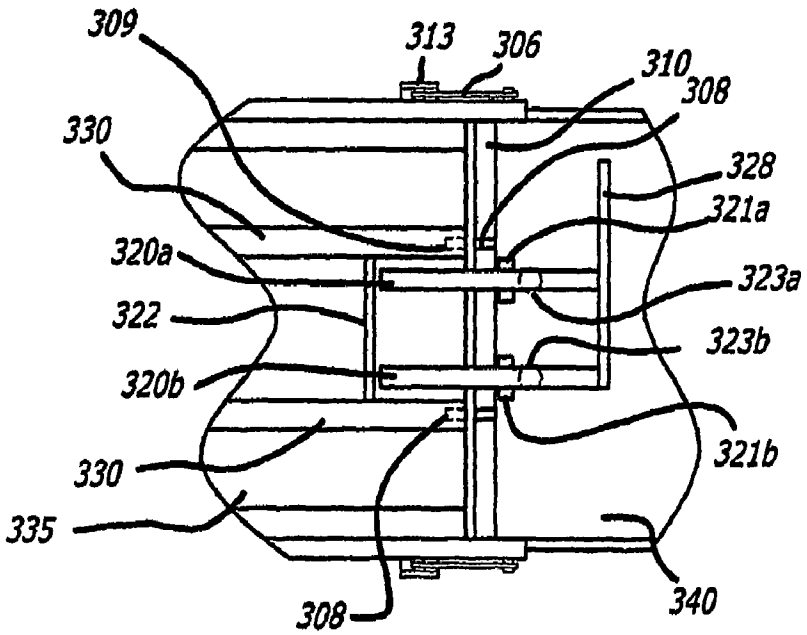
FIG. 17 is a bottom plan view of a portion of the ironing board according to the third embodiment of the present invention, with the ironing board fully extended and the secondary board rotated into a position approximately coplanar with the primary board.

A bottom plan view of ironing board assembly 300 in the vicinity of gap 310 in this position is shown in FIG. 17. In this embodiment, as shown in FIG. 17, hook 320 includes two separate arms 320*a* and 320*b*, with corresponding pivot points 321*a* and 321*b* and corresponding compression springs 323*a* and 323*b*. However, a single arm may instead be used. Anchor 322 is similar to anchors 122 and 222, described above, and is disposed between support rails 330 on primary board 335.

Figure 16:
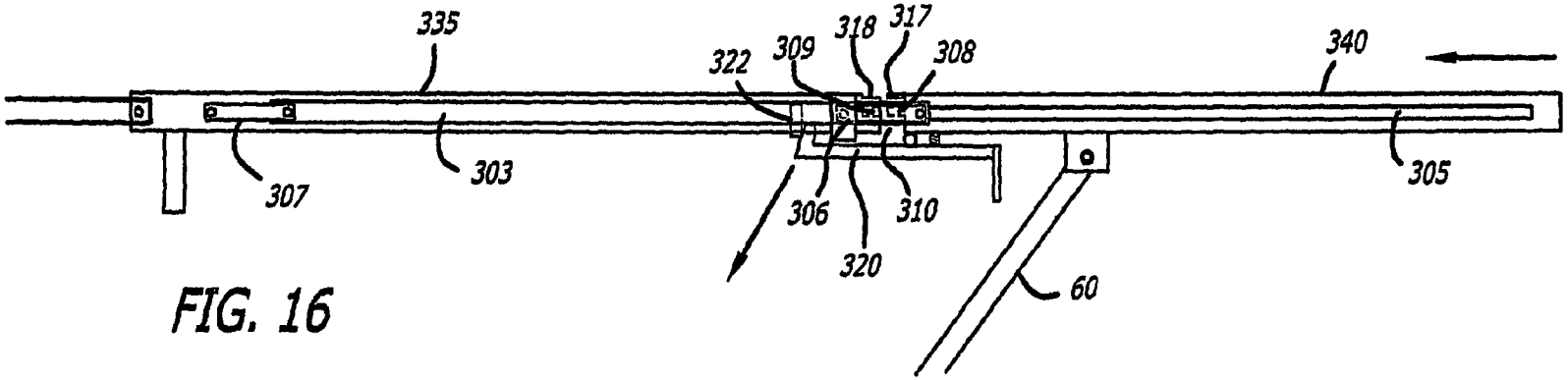
FIG. 16 is a right side elevational view of an ironing board assembly according to the third embodiment of the present invention, with the ironing board fully extended and the secondary board rotated into a position approximately coplanar with the primary board.

Referring to FIGS. 16 and 17, starting from the position shown in those figures and manually sliding secondary board 340 in a straight horizontal manner causes pegs 308 to insert into slots 369. Also, due to the angled rear edge of hook 320, this action causes hook 320 to rotate downwardly, slide underneath anchor 322 and then, upon clearing anchor 322, to snap back up, thereby engaging with anchor 322 at a point where primary and secondary boards 335 and 340 abut each other.

Figure 18:
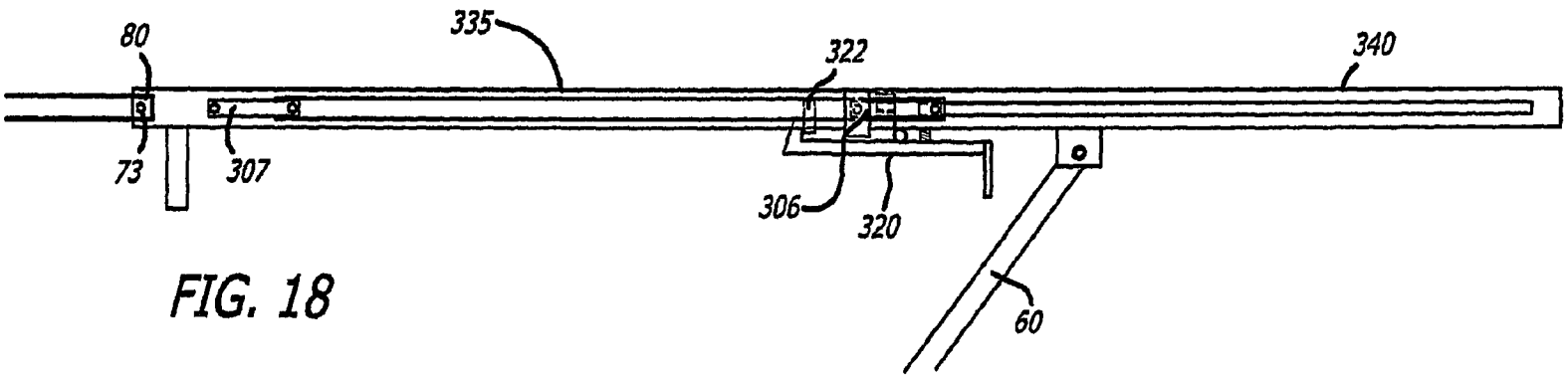
FIG. 18 is a right side elevational view of an ironing board assembly according to the third embodiment of the present invention, with the ironing board fully extended, and the secondary board rotated into a position approximately coplanar with the primary board and pushed rearwardly so as to lock into position with the primary board.

The end result is illustrated in FIG. 18. In this configuration, hook 320 and anchor 322 together prevent secondary board 340 from extending out further, the contact between primary and secondary boards 335 and 340 prevents secondary board 340 from moving inwardly, and locking pin assembly 80 prevents the entire assembly 300 from rotating about pivot point 73.

In order to return ironing board assembly 300 to the stored position, handle 328 is pushed upwardly, thereby releasing hook 320 from anchor 322. In addition, locking pin 84 is removed from hole 83 and the entire assembly 300 is pushed downwardly, causing secondary board 340 to return to its storage position underneath primary board 335 and, correspondingly, the entire assembly 300 to return to the stored position shown in FIG. 12. This motion also causes hook 320 to re-engage with storage anchor 325 in the same manner described above in which hook 320 attaches to anchor 322 when the board assembly 300 is being deployed.

In this third embodiment described above, the outer track 303 is attached to the pivot arms 306 and 307, and the inner track 305 is mounted to the secondary board 340. However, in alternate embodiments of the invention the inner track 305 may be attached to pivot arms 306 and 307 while the outer track 303 is mounted to the edge of the secondary board 340. In addition, rather than using only a single inner track and a single outer track it is possible to instead use one or more traditional tracks, floating between the track attached to the edge of the secondary board 340 and the track attached to the pivot arms 306 and 307. Still further, rather than providing only two pivot arms near the front and rear ends of primary board 335, it is possible to provide any number of pivot arms, with the choice regarding the appropriate number being based upon engineering considerations.

Additional Considerations

In the embodiments described above, shaft 60 is a pneumatic piston cylinder mechanism, similar to an automobile shock absorber. However, in other embodiments shaft 60 may be implemented as a hydraulic piston/cylinder mechanism, operated by a pump (manual or electric) and a release valve in the same manner described above with respect to lifting mechanism 18. Still further, shaft 60 may be a purely mechanical device, similar to a common conventional mechanical car jack.

Also, several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality may be ascribed to a particular module or component. However, unless any particular functionality is described above as being critical to the referenced module or component, functionality may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A collapsible ironing board, comprising:

(a) a frame;

(b) a primary board having a top surface, a bottom surface, a front edge, a rear edge, a left side and a right side, and being pivotally attached to the frame at the rear edge of the primary board;

(c) a secondary board having a top surface, a bottom surface, a front edge, a rear edge, a left side and a right side, and being slidably attached to the primary board such that the secondary board can be slid from a stored position in which the top surface of the secondary board is beneath the bottom surface of the primary board to an extended position in which the rear edge of the secondary board is in front of the front edge of the primary board and the top surface of the secondary board is at least approximately coplanar with the top surface of the primary board;

(d) an extendable/retractable shaft having a proximal end that is pivotally attached to the frame and a distal end that is pivotally attached to the secondary board; and (e) a lifting mechanism operable to raise and lower the frame.

2. A collapsible ironing board according to claim 1, wherein the extendable/retractable shaft is pressurized.

3. A collapsible ironing board according to claim 2, wherein the extendable/retractable shaft is comprised of a pneumatic piston-and-cylinder mechanism.

4. A collapsible ironing board according to claim 2, wherein the extendable/retractable shaft comprises a hydraulic mechanism.

5. A collapsible ironing board according to claim 2, wherein the extendable/retractable shaft comprises a gas-pressurized mechanism.

6. A collapsible ironing board according to claim 2, wherein the extendable/retractable shaft comprises a telescoping piston-cylinder arrangement.

7. A collapsible ironing board according to claim 1, wherein the extendable/retractable shaft is spring-loaded.

8. A collapsible ironing board according to claim 1, further comprising a housing, and wherein the frame is pivotally attached to the housing.

9. A collapsible ironing board according to claim 1, wherein the lifting mechanism is operated via at least one of an electric pump and a foot pump.

10. A collapsible ironing board according to claim 1, further comprising a coupling mechanism operable to couple the primary board to the secondary board.

11. A collapsible ironing board according to claim 1, wherein the secondary board is slidably attached to the primary board using a J-shaped groove attached to each of the right side and the left side of the primary board.

12. A collapsible ironing board according to claim 1, wherein the secondary board is slidably attached to the primary board using a telescoping track attached to each of the right side and the left side of the primary board and the secondary board.

13. A collapsible ironing board comprising:

(a) frame;

(b) a primary board having a top surface, a bottom surface, a front edge, a rear edge, a left side and a right side, and being pivotally attached to the frame at the rear edge of the primary board;

a secondary board having a top surface, a bottom surface, a front edge, a rear edge, a left side and a right side, and being slidably attached to the primary board such that the secondary board can be slid from a stored position in which the top surface of the secondary board is beneath the bottom surface of the primary board to an extended position in which the rear edge of the secondary board is in front of the front edge of the primary board and the top surface of the secondary board is at least approximately coplanar with the top surface of the primary board;

(d) an extendable/retractable shaft having a proximal end that is pivotally attached to the frame and a distal end that is pivotally attached to the secondary board; and e) a pivot arm attached to the primary board and the secondary board for allowing the secondary board to raise up from underneath the primary board to where the top surface of the secondary board is at least approximately coplanar with the top surface of the primary board, wherein the secondary board is slidably attached to the primary board using a telescoping track attached to each of the right side and the left side of the primary board and the secondary board.

14. A collapsible ironing board, comprising:

(a) a frame;

(b) a primary board having a top surface, a bottom surface, a front edge, a rear edge, a left side and a right side, and being pivotally attached to the frame at the rear edge of the primary board;

(c) a secondary board having a top surface, a bottom surface, a front edge, a rear edge, a left side and a right side;

(d) carriage means for slidably attaching the secondary board to the primary board such that the secondary board can be slid from a stored position in which the top surface of the secondary board is beneath the bottom surface of the primary board to an extended position in which the rear edge of the secondary board is in front of the front edge of the primary board and the top surface of the secondary board is at least approximately coplanar with the top surface of the primary board;

(e) extension/retraction means for extending in length and retracting in length under control of an operator, said extension/retraction means having a distal end that is pivotally attached to the frame and a proximal end that is pivotally attached to the secondary board; and (f) lifting means for raising and lowering the frame.

15. A collapsible ironing board according to claim 14, wherein the extension/retraction means is pressurized.

16. A collapsible ironing board according to claim 15, wherein the extension/retraction means comprises a hydraulic mechanism.

17. A collapsible ironing board according to claim 15, wherein the extension/retraction means comprises a gas-pressurized mechanism.

18. A collapsible ironing board according to claim 15, wherein the extension/retraction means comprises a telescoping piston-cylinder arrangement.

19. A collapsible ironing board according to claim 14, wherein the extension/retraction means is spring-loaded.

20. A collapsible ironing board according to claim 14, wherein the extension/retraction means is electrically actuated.

21. A collapsible ironing board according to claim 14, further comprising a housing, and wherein the frame is pivotally attached to the housing.

22. A collapsible ironing board according to claim 14, wherein the lifting means is operated via at least one of an electric pump and a foot pump.

23. A collapsible ironing board according to claim 14, further comprising coupling means for coupling the primary board to the secondary board.

24. A collapsible ironing board according to claim 14, wherein the secondary board is slidably attached to the primary board using a J-shaped groove attached to each of the right side and the left side of the primary board.

25. A collapsible ironing board according to claim 14, wherein the secondary board is slidably attached to the primary board using a telescoping track attached to each of the right side and the left side of the primary board and the secondary board.

26. A collapsible ironing board according to claim 25, further comprising a pivot arm attached to the primary board and the secondary board for allowing the secondary board to raise up from underneath the primary board to where the top surface of the secondary board is at least approximately coplanar with the top surface of the primary board.

* * * * *